US005421140A

United States Patent [19]

Theriault

[11] Patent Number: 5,421,140

[45] Date of Patent: Jun. 6, 1995

[54] TREE COMPRESSING AND PACKAGING APPARATUS

[76] Inventor: Ralph Theriault, 30 Pine St., Newington, Conn. 06111

[21] Appl. No.: 159,380

[22] Filed: Nov. 30, 1993

[51] Int. Cl.[6] ..... B65B 13/20

[52] U.S. Cl. ..... 53/530; 53/139.4; 53/439; 53/576; 53/529; 100/3; 100/13; 100/100; 100/144; 254/314; 254/386

[58] Field of Search ..... 47/1.01, 4; 100/3, 8, 100/12, 13, 27, 100, 144, 145; 254/314, 386; 53/459, 529, 530, 539, 567, 576, 588, 469, 139.4; 144/2.2; 74/110

[56] References Cited

U.S. PATENT DOCUMENTS

| | | | |
|---|---|---|---|
| 2,720,055 | 10/1955 | Morris . | |
| 2,856,845 | 10/1958 | Beyette . | |
| 2,966,111 | 12/1960 | Yafjack . | |
| 2,974,457 | 3/1961 | Saxton . | |
| 3,358,418 | 12/1967 | Manetta . | |
| 3,380,220 | 4/1968 | Jennings et al. . | |
| 3,416,434 | 12/1968 | Woserau et al. . | |
| 3,445,985 | 5/1969 | Manetta . | |
| 3,473,291 | 10/1969 | Raymond et al. . | |
| 3,747,293 | 7/1973 | Van Slooten et al. . | |
| 3,760,556 | 9/1973 | Morris | 53/530 |
| 4,289,177 | 9/1981 | Hammond et al. | 144/2 Z |
| 4,291,734 | 9/1981 | Hammond | 144/2 Z |
| 4,619,193 | 10/1986 | Crew . | |
| 4,759,169 | 7/1988 | Schneiders . | |
| 4,888,937 | 12/1989 | Glenn . | |
| 4,939,989 | 7/1990 | Zacharias . | |

FOREIGN PATENT DOCUMENTS

| | | |
|---|---|---|
| 846623 | 7/1970 | Canada . |

*Primary Examiner*—W. Donald Bray
*Attorney, Agent, or Firm*—McCormick, Paulding & Huber

[57] ABSTRACT

A tree compressing and binding apparatus has particular usefulness in handling of Christmas trees, employs a hydraulic power system which utilizes the even stroke of one or a plurality of hydraulic cylinders to drive a tree through a loader funnel. The apparatus is capable of being used in harsh weather environments and provides a low cost mechanism for packaging trees either for point of sales use or for large scale harvesting and shipping jobs.

15 Claims, 3 Drawing Sheets

TREE COMPRESSING AND PACKAGING APPARATUS

BACKGROUND OF THE INVENTION

This invention relates to an apparatus for packaging trees from an otherwise spread condition, such as in the case with Christmas trees, and deals more particularly with an improvement in such devices whereby a simplified, low cost, reliable and mechanically efficient apparatus is used to package such trees in environments and in conditions which may be adverse.

Mechanisms for packaging Christmas trees in compressed form are desirable because in such a compressed form, shipping of trees in large quantities can be effected, such as between a tree farm and distribution points in a local marketing area. Mechanisms for packaging Christmas trees or the like are known in the art. Such packaging is accomplished by using an open mesh netting or sock which receives a corresponding length of tree as the tree is moved through a compressing funnel. This netting allows the tree to breathe while simultaneously holding it in its compressed form. Also, once the trees are brought to the lot or site where sales are to be made, the trees must be unpackaged for purposes of viewing by a potential buyer, unless purchase is to be made cite unseen which is not usually the case with the purchasing of Christmas trees or trees used for other aesthetic purposes. In the case of Christmas tree purchases, once a tree is selected, it is usually somehow tied down onto the vehicle, packed into the trunk or the vehicle interior. Such arrangements have been known to cause breakage of branches as well as causing safety problems in the case where the tree breaks away from the vehicle. As an alternative to such a mode of handling, the trees may be repackaged again for transport by the user to their home at the point of sale. Thus, packaging apparatus are more and more becoming prevalently found at points of sales of trees as well as being commonly found at farms where packaging for mass shipment occurs normally.

Apparatus for compressing and packaging trees are known in the art. One such mechanism is disclosed in U.S. Pat. No. 2,720,055, issued to Morris on Oct. 11, 1955. In the mechanism disclosed in this patent, a tree is drawn through a loading tube starting at the base and proceeding upwardly thereof to cause the tree to be compressed and to flex the branches of the tree inwardly as it is moved endwise therethrough. The mechanism used to move the tree endwise through the loading tube is a rack and pinion drive which is adapted so as to move a rack longitudinally along length of the apparatus by a pinion gear acting against the rack through suitable power transmission means. The rack is in turn connected to an arm which is attached to the base of the tree to cause it to be pulled through the loading tube. The use of a rack bar and pinion drive as disclosed in U.S. Pat. No. 2,720,055, is problematic in that the costs associated with machining the rack adds significantly to the overall manufacturing cost of the machine. Additionally, the rack must itself be moved the entire stroke length required to pull the tree through the loading tube which adds to the power requirement needed to effect such tree movement. Similarly, in U.S. Pat. No. 3,416,434, issued to Woserau et al. on Dec. 17, 1968, a Christmas tree loader apparatus is disclosed wherein the mechanism for moving a tree endwise of a funnel is an endless chain drive mounted between two end drive sprockets at either end of the mechanism. Such chain drives require frequent lubrication and often have limited capacity to pull large trees through the compressing funnel.

Accordingly, it is an object of the invention to provide a low cost highly mechanically efficient and reliable powered tree packaging apparatus which is capable of being used either in the context of large scale farms or at points of sale.

It is still a further object of the invention to provide a tree packaging apparatus of the aforementioned type wherein previously expensive and mechanically inefficient drive mechanisms are eliminated to effect smoother more reliable drive motion of a tree pulled endwise through a compressing funnel.

Still a further object of the invention is to provide a tree packaging apparatus of the aforementioned type wherein the mechanism used for packaging trees is made capable of working in environmentally adverse conditions through simplicity of function.

SUMMARY OF THE INVENTION

An apparatus for compressing and packaging a tree comprises a frame having a first end and a second end disposed along a central axis and a hydraulic actuator means mounted to the frame and having at least one moving part movable between extended and retracted positions for pulling a tree along the length of the frame generally in line with the central axis. A ram means is connected to the at least one movable part of the hydraulic actuator means for movement between a one position corresponding to the at least one movable part being moved to the extended position and an another position corresponding to the at least one movable part being moved to the retracted position. Power means is provided and is secured to the frame and includes a pressurizing means fluidically connected to the actuator means to cause pressurized fluid to be introduced into the actuator means and to cause the return of fluid introduced into the actuator means back to the power means. A tree compressing and binding means is provided and is located at one of the first and second ends of the frame for compressing a tree from and otherwise relaxed condition and binding it to maintain the tree in a compressed condition. The ram means includes a means for attaching it to the base of a tree and pulling the tree through the compressing and binding means toward the other of the first and second ends of the table. A control means is provided and is associated with the power means for controlling the ram means movement between the one position corresponding to the at least one movable part being moved to the extended position and an another position corresponding to the at least one movable part being moved to the retracted position such that the second end of the flexible member is caused to be drivingly moved from a first position coinciding generally with the location of the compressing and binding means to a second position coinciding with the location of the other of the first and second ends of the frame.

DETAILED DESCRIPTION OF THE PREFERRED EMBODIMENT

Figure 1:
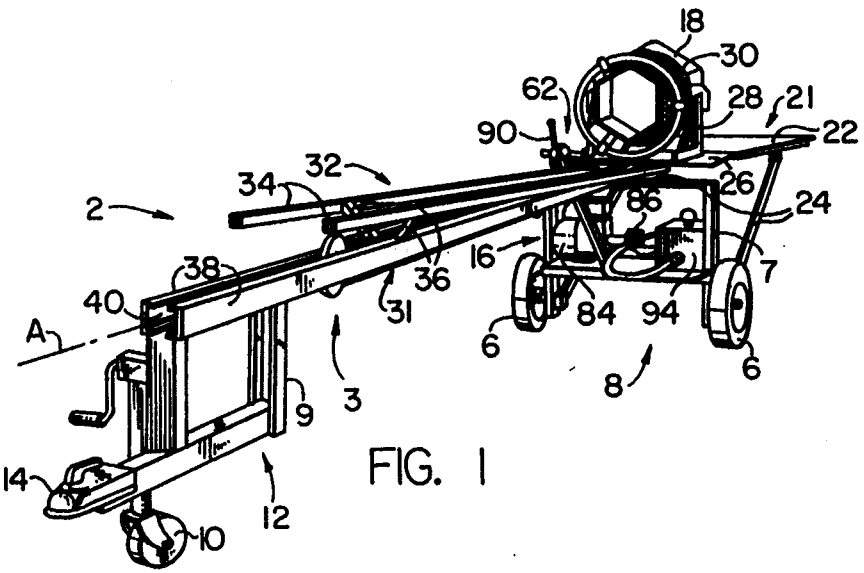
FIG. 1 is a perspective view showing the tree packaging apparatus of the invention.
Figure 2:
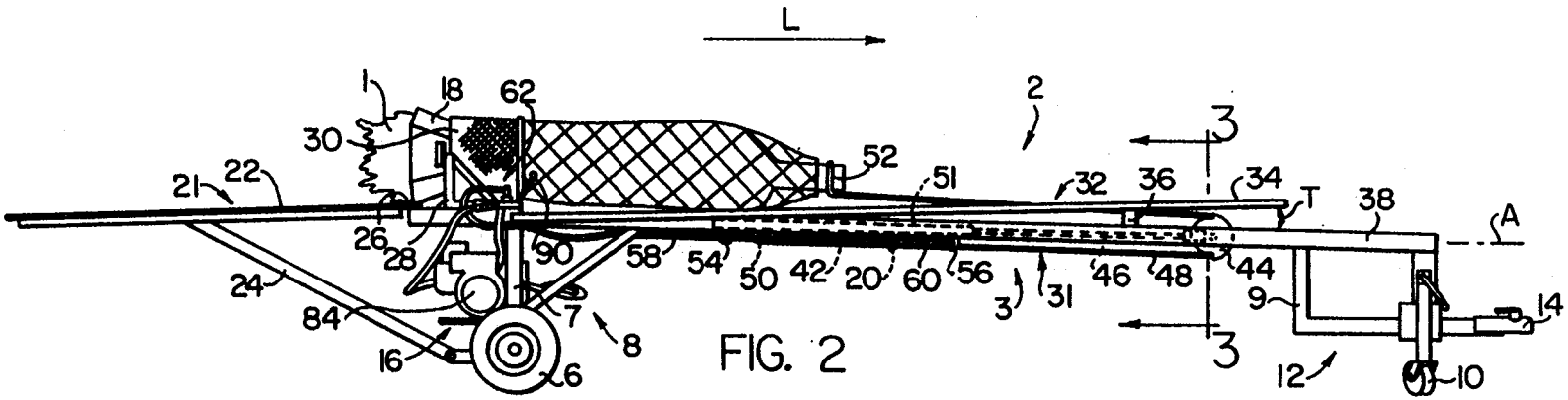
FIG. 2 is a side elevation view of the apparatus shown in FIG. 1.

An apparatus shown generally as 2 in FIG. 1 embodies the invention. The apparatus 2 includes a frame 3 having an elongate portion 31 extending along a main axis A and supported in beam-like fashion above the ground by end frames 7 and 9 which respectively include a pair of rear wheels 6,6 disposed at one end 8 of the frame and a directional wheel 10 disposed at the opposite or frontal end 12. The end frame 9 associated with the frontal end 12 includes a hitching element 14 which allows the apparatus to be readily transported for on site use through a simple hook up to a motor vehicle trailer hitch. The end frame 7 associated with the one end 8 of the apparatus supports a power means 16 for causing a tree 1 to be moved through a loader funnel 18 disposed at the one end 8 of the apparatus 2 and secured against movement to the associated end frame 7. The power means 16 is fluidically coupled to a drive means 20 housed within the frame 3 for moving a tree 1 along the indicated line of action L between the one 8 and the other ends 12 of the apparatus. As illustrated in FIG. 2, the one end 8 of the apparatus corresponding to the onloading point for the tree 1, includes a loading table 21 providing a support surface 22 on which the tree 1 rests prior to being feed through the funnel 18. The table 21 is supported on the end frame 7 by a plurality of support arms 24,24 connected between the table and the frame through appropriate pivotal connections. The end of the table 21 located proximate the frame 7 includes an extended lip 26 provided for the purpose of resting on the end frame 7 to thereby maintain the trunk of the tree in a substantially parallel relationship with the line of action L traveled by the tree along the length of the apparatus. Located adjacent the lip or leading edge of the table 21 is the funnel loader 18 which is mounted to a substantially L-shaped frame 28 secured against movement to the end frame 7 by an appropriate securement device, such as, bolt fasteners, or alternatively, the L-shaped frame 28 may be releasably secured against movement by abutment stops fixed to the frame 7 and engaging under the lip of a lower transverse member of the L-shaped frame 28. Included as part of the loader funnel 18 and disposed thereabout is a supply of plastic netting 30 which is used to bind the tree as it exits the funnel 18. The netting is commercially available and is sold in cartridge packaged by for example, The KIRK Co., P.O. Box 340, Puyallup, Wash., 98371 and sold under the tradename Tree Tie Netting.

On the side of the loading funnel opposite the loading table 21 is a take off ramp 32 extending in the direction of tree movement L. The ramp 32 is supported on an elongate portion of the frame 3 which extends in line with and is symmetrical about the axis A of the apparatus. The take-off ramp is comprised of two laterally spaced guide bars 34,34 each disposed on opposite sides of the longitudinal axis A of the elongate frame portion 31. Each of the bars 34,34 which make up the ramp 32 is connected to the frame 3 through individual support arms 36,36 which extend obliquely from the frame 3 upwardly and connect to the bars giving the ramp 32 a slight angle T taken relative to the axis A of approximately 10 degrees. As will become apparent later, this angular orientation of the ramp 32 serves to more effectively draw the tree endwise along the ramp 32 as it is being pulled by the drive means.

The elongate portion 31 of the frame 3 is defined by two elongate C-shaped channel members 38,38 arranged in an opposing relationship with one another to define a generally internal confine 40 therebetween. The channels are maintained in this relationship by a weldament securing respective ends of the members 38,38 to the end frames 7 and 9 at the ends 8 and 12 of the frame 3. Within the confine 40 defined by the opposed channels 38,38 is disposed the drive means 20 which acts on the base of the tree 1 to pull it through the loader funnel 18 and thereby cause the plastic netting to envelope the tree as it is drawn through. The drive means 20 for this purpose includes a cylinder actuator means 42 disposed internally within the confine 40 and is secured against movement therein by a transverse pin. Associated with the actuator means 42 is a ram-pulley 44 connected to it through a piston rod 46 slidingly received within the cylinder of the actuator means for movement between extended and retracted positions. Disposed about the ram-pulley 44 is a pulling cable 48 connected at one of its ends to the channels 38,38 at a securement point 50 and having a free end 52 defined by a tightening noose formed thereon for gripping the base of the tree upon the tensioning of the cable 48.

Figure 3:
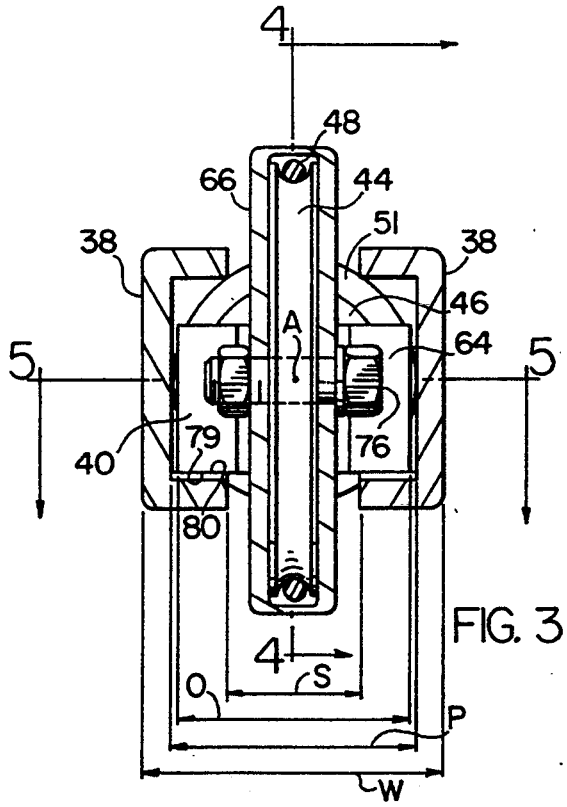
FIG. 3 is a vertical section of view taken along line 3—3 of FIG. 2.
Figure 4:
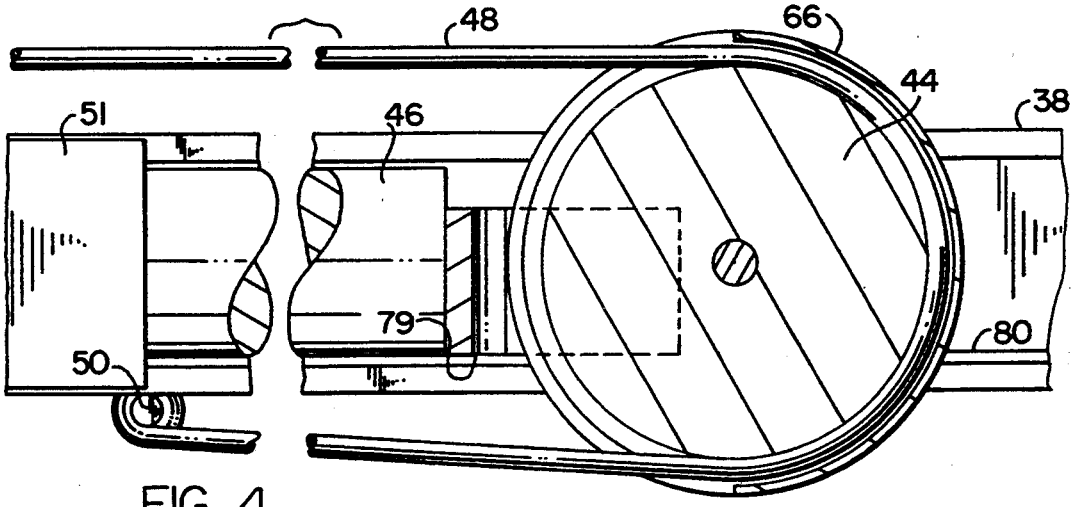
FIG. 4 is a partially fragmentary vertical sectional view taken along line 4—4 of FIG. 3.
Figure 5:
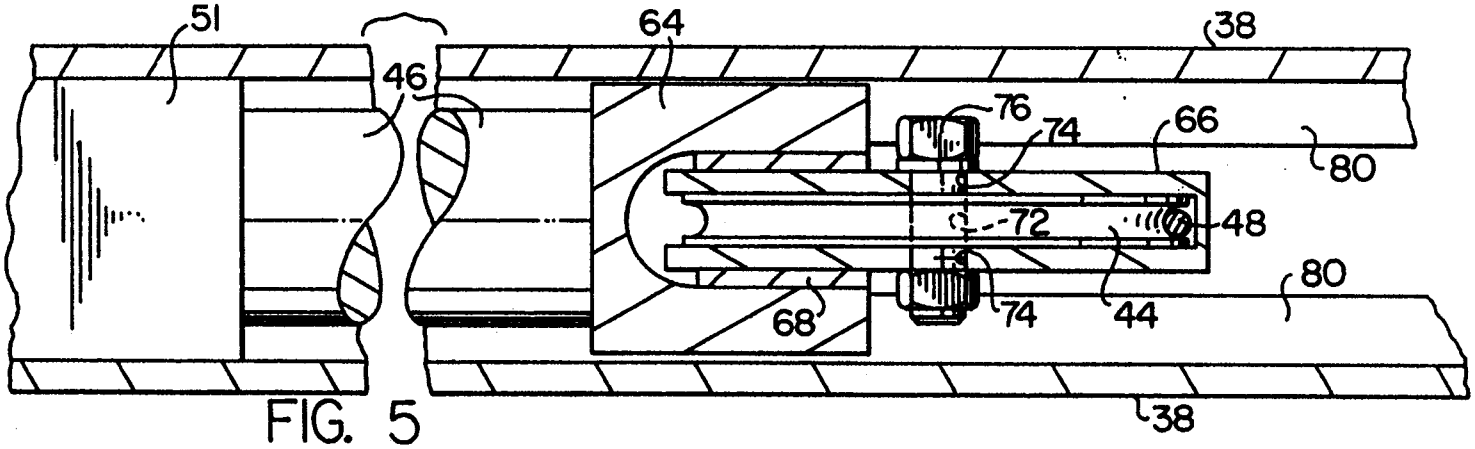
FIG. 5 is a partially fragmentary view taken along line 5—5 in FIG. 3.

Referring now to FIGS. 3–5, it should be seen that the cylinder actuator means 42 includes a cylinder 51 having first and second inlets 54 and 56 respectively associated with the expansion and retraction actions of the sliding piston rod 46. The first inlet 54 is fluidically connected to the power means 16 through a first fluid line 58 and the second inlet 56 is fluidically connected to the power means 16 by a second fluid line 60 for the purpose of introducing and venting fluid through each of the inlets to effect extension and retraction of the ram-pulley 44. In the embodiment of FIG. 1, the cylinder actuator 51 has a length of about six feet and displaces the piston rod 46 through a stroke of about 72 inches. The fluid lines 58 and 60 connect at the ends opposite those which connect to inlets 54 and 56 to a control means 62 which selectively redirects pressurized hydraulic fluid between the first and second inlets. As such, the ram-pulley 44 being secured to the free end of the piston rod, is driven by hydraulic fluid between a retracted position and an extended position to cause the free end 52 of the cable 48 to be pulled toward the front end 12 of the apparatus. A more complete discussion of the hydraulic system will be made with reference to FIG. 7, but for the moment it should be understood that the control means is disposed at the on-loading end 8 to enable single operator usage of the apparatus.

The channels 38,38 are spaced apart from each other by a distance W equaling approximately three inches and are held in such arrangement through the intermediary of a weldament connection so as to tangentially surround the circular cross-sectional shape of the cylinder actuator 51. The ram-pulley is connected to the end of the piston rod 46 through the intermediary of a yoke member 64 which is fixed by a weld to the free end of the rod 46, and the yoke member 64 is in turn connected to a pulley housing 66 through a weldament connection 68 in which pulley housing is disposed a freely rotating pulley member 44 around which the cable 48 is trained. The rotating pulley 44 has a through opening 72 aligned with like openings 74,74 formed in the housing 66 through which openings a journalling bolt 76 is disposed. The C-shaped channels 38,38 are held in a spaced relationship with one another as indicated by the dimension S, which spacing provides a path along which the ram-pulley 44, whose height exceeds that of the C-shaped channels 38,38, can travel. The ram-pulley 44 is maintained in lateral alignment within the internal confine 40 by the width 0 of the yoke 64. The width 0 is dimensioned slightly smaller than the passage P defined by the opposing upstanding internal sidewalls of the channels 38. The yoke member 64 is so connected to the end of the piston rod 46 as to locate the bottom face 79 of the yoke member in engagement with the confronting upwardly facing surface 80 of the channel members. In use, the surfaces 80,80 are covered by an appropriate lubricant, such as, grease, allowing the ram-pulley to slide primarily along the surfaces 80,80 in a reciprocating manner within the internal confine 40 created by the opposed channel members 38,38.

Figure 7:
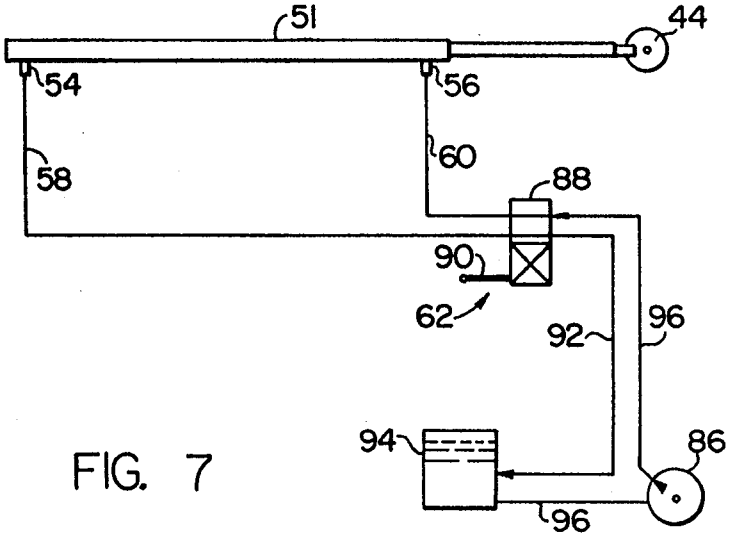
FIG. 7 is a schematic of the hydraulic control system of the apparatus.

The power means 16 includes a gasoline engine 84 secured to the end frame 7 and is connected in rotation to a fluid pump 86 mounted to that end frame for the purpose of introducing pressurized fluid into the cylinder actuator means 42 through respective ones of the inlets 54 and 56. The pump 86 selected is of the type having a rating of 2.8 gallons per minute at 1800 rpm and the engine 84 is a 5-horsepower gas operated four stroke motor. The control means 62 as illustrated generally in FIG. 7 is comprised of a valve 88 having a lever actuator 90 which moves the valve between positions controlling the flow of fluid to and from the inlets 54 and 56 of the cylinder actuator 42. As between the valve 88 and the pump 86, a return line 92 is provided and fluidically connects the valve 88 to a fluid reservoir 94 for the purpose of feeding fluid back to the reservoir 94 as it is displaced from the cylinder actuator means 42. A feedline 96 is also provided and is fluidically connected between the reservoir 94 and the pump 86 and the valve 88 for the purpose of drawing fluid from the reservoir and causing it to be pressurized at the pump 86 and introduced under pressure at the valve 88. The valve 88 is one of the type used in log splitters and is commercially sold and manufactured by Price Manufacturing Corporation of Sioux City, Iowa.

Figure 6:
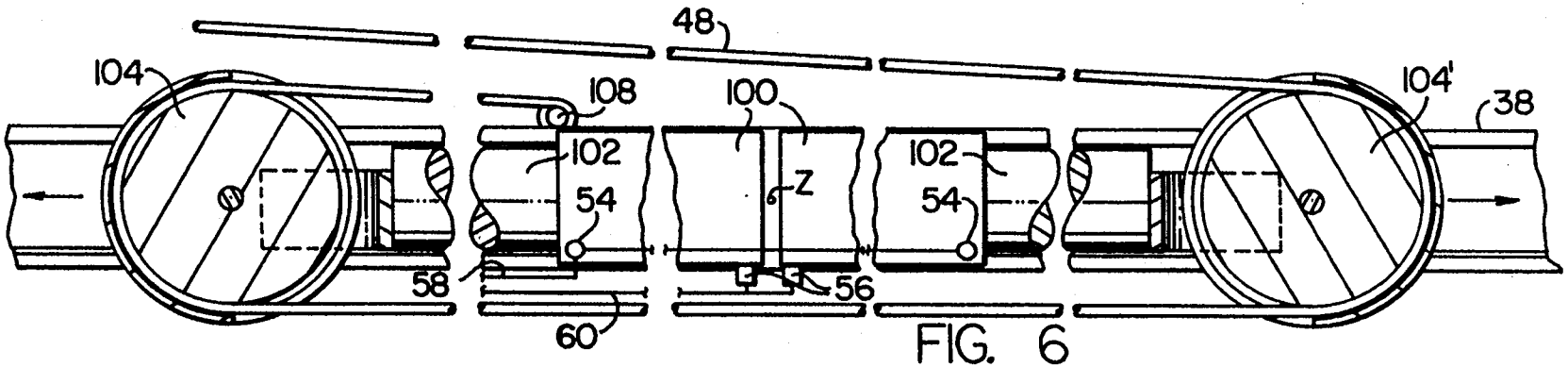
FIG. 6 is a partially fragmentary vertical section view through the length of the apparatus of FIG. 1 showing a second embodiment.

Referring back to FIG. 6, it should be seen that the apparatus of the invention can be practiced in a somewhat different manner in that instead of providing the single cylinder actuator 51, two hydraulic cylinders 100,100 are provided and are arranged in tandem and are secured against movement within the confine 40 provided by the opposed C-shaped channels 38,38. Each of the cylinders 100,100 includes a piston rod 102,102 which extend outwardly away from the common securement point Z of the opposed ends of the tandem actuators. The free end of each piston rod in turn carries a ram-pulley 104,104' which are caused to move in the directions indicated by the arrows away from the securement point Z when appropriately energized by the pressurized fluid. The cable 48 in the embodiment shown herein is secured against movement at point 108 to the frame portion 31 and is thereafter caused to make a first turn around the leftmost pulley 104 and thereafter travel the length of the tandem actuators and thereafter caused to be trained around the rightmost pulley 104', and thereafter be turned back toward the loading table 21. In this way, the combined extensions of the piston rods 102,102 act on the cable 48 to the free end 52 of the cable 48 to be moved rightward toward the end 12 of the apparatus 2. In the embodiment of FIG. 6, the first and second inlets of each of the actuators 100,100 are connected in series respectively to the same ordered inlet of the other actuator so that a single one of the lines 58 and 60 can be used to direct fluid to and from the valve 88 in the manner discussed with reference to FIG. 7.

In use, an operator places an unwrapped tree on the loading table 21 with its base directed toward the loading funnel 18. If the cylinder actuator(s) has not been energized so as to return the piston rod(s) to the retracted condition, then such retraction is effected by the appropriate movement of the handle 90 of the valve 88. In so doing, a length of cable is freed from an otherwise displaced location disposed at the end 12 of the apparatus 2, and which length is sufficient to substantially pass through the loading funnel 18. Thereafter, the noose located at the free end of the cable 48 is placed around the base of the tree and is slightly tensioned by the operator manually to insure that it is seated about the base of the tree 1. Thereafter, the operator moves the lever 90 to energize the appropriate chamber of the cylinder actuator 51 and thereby cause the ram-pulley 44 to extend toward the end 12 of the apparatus. In so doing, the displacement of the pulley 44 causes the given length of cable to be taken up such that the tree 1 is pulled smoothly through the loader funnel 18 and the netting 30 is then caused to bind around the tree with its continued advancement through the loader funnel. This smoothness of motion is the result of the way by which the cable 48 is trained about the ram-pulley 44. That is, for every unit of displacement effected by the ram-pulley 44, two such units of the length of the cable 48 are in turned displaced. This allows for a more compact design lengthwise, as well as providing a force multiplying characteristic.

By the foregoing, an apparatus has been described in the preferred embodiment and numerous modifications and substitutions may be had without departing from the spirit of the invention. For example, while reference to the left and right orientations of elements, such as the tandem actuators 100,100 have been made, such reference is made for the purpose of reference rather than limitation.

Accordingly, the invention has been described by way of illustration rather than limitation.

I claim:

1. An apparatus for compressing and packaging a tree comprising:

a frame having a first end and a second end disposed along a central axis;

actuator means mounted to said frame and having at least one moving part movable between extended and retracted positions;

ram means connected to said at least one movable part of said actuator means for movement between a one position corresponding to the at least one movable part being moved to the extended position and an another position corresponding to the at least one movable part being moved to the retracted position;

power means secured to the frame and including a pressurizing means fluidically connected to the actuator means to cause pressurized fluid to be introduced into said actuator means and to cause the return of fluid introduced into the actuator means back to the power means;

a flexible elongate member having a length defined by a first and a second end, said first end being secured against movement to said frame and said second end having means for attaching it to the base of a tree, said flexible elongate member further being trained around said ram means intermediate its first and second ends;

compressing and binding means located at one of said first and second ends of the frame for compressing a tree from and otherwise relaxed condition and binding it to maintain the tree in a compressed condition; and control means associated with said power means for controlling the ram means movement between said one position corresponding to the at least one movable part being moved to the extended position and an another position corresponding to the at least one movable part being moved to the retracted position such that said second end of said flexible member is caused to be drivingly moved from a first position coinciding generally with the location of said compressing and binding means to a second position coinciding with the location of the other of said first and second ends of the frame.

2. An apparatus as defined in claim 1 further characterized by said frame including a first support means disposed on one side of the compressing and binding means and a second support means disposed on the other side of said compressing and binding means, with each of said first and second support means being located in line coincidentally with said frame central axis.

3. An apparatus as defined in claim 2 further characterized by said power means including a gasoline powered engine drivingly connected to a pump and said actuator means being a hydraulic actuator having a sliding rod onto which said ram means is connected movable between said retracted and extended positions as the result of selective introduction of pressurized fluid into said hydraulic actuator.

4. An apparatus as defined in claim 3 further characterized in that said frame includes an elongate portion supported in a beam-like manner by first and second end frames, said elongate portion of said frame being defined by two opposed C-shaped channels fixed to said first and second end frames in spaced relationship with one another to create an internal confine therein.

5. An apparatus as defined in claim 4 further characterized by said ram means including a yoke member connected to said sliding rod and slidingly received within said internal confine of said elongate portion of said frame.

6. An apparatus as defined in claim 5 further characterized by said hydraulic actuator being sized and dimensioned so as to be received within the internal confine with said elongate portion of said frame and said ram means includes a pulley rotatably mounted to said yoke.

7. An apparatus as defined in claim 2 further characterized by said power means including a gasoline powered engine drivingly connected to a pump and said actuator means being two hydraulic actuators arranged in tandem and each having a sliding rod onto which said ram means is connected movable between said retracted and extended positions as the result of selective introduction of pressurized fluid into said hydraulic actuator.

8. An apparatus as defined in claim 7 further characterized in that said frame includes an elongate portion supported in a beam-like manner by first and second end frames, said elongate portion of said frame being defined by two opposed C-shaped channels fixed to said first and second end frames in spaced relationship with one another to create an internal confine therein.

9. An apparatus as defined in claim 8 further characterized by said ram means including a yoke member connected to said sliding rod and slidingly received within said internal confine of said elongate portion of said frame.

10. An apparatus as defined in claim 9 further characterized by said hydraulic actuators each being sized and dimensioned so as to be received within the internal confine with said elongate portion of said frame and said ram means includes a pulley rotatably mounted to said yoke.

11. An apparatus as defined in claim 7 further characterized by said compressing and binding means being a funnel loader having a supply of netting disposed thereabout which is caused to bind around a tree exiting from the loader.

12. An apparatus as defined in claim 3 further characterized by said compressing and binding means being a funnel loader having a supply of netting disposed thereabout which is caused to bind around a tree exiting from the loader.

13. An apparatus as defined in claim 3 further characterized by said control means includes first and second fluid lines connected to said hydraulic actuator each responsible for said ram means being movable between said retracted and extended positions as the result of selective introduction of pressurized fluid alternatingly into said first and second fluid lines.

14. An apparatus as defined in claim 7 further characterized by said control means includes first and second fluid lines each connected two said two actuators in parallel and each responsible for said ram means being movable between said retracted and extended positions as the result of selective introduction of pressurized fluid alternatingly into said first and second fluid lines.

15. An apparatus for compressing and packaging a tree comprising:

a frame having a first end and a second end disposed along a central axis;

hydraulic actuator means mounted to said frame and having at least one moving part movable between extended and retracted positions for pulling a tree along the length of said frame generally in line with said central axis;

ram means connected to said at least one movable part of said hydraulic actuator means for movement between a one position corresponding to the at least one movable part being moved to the extended position and an another position corresponding to the at least one movable part being moved to the retracted position;

power means secured to the frame and including a pressurizing means fluidically connected to the actuator means to cause pressurized fluid to be introduced into said actuator means and to cause the return of fluid introduced into the actuator means back to the power means;

compressing and binding means located at one of said first and second ends of the frame for compressing a tree from and otherwise relaxed condition and binding it to maintain the tree in a compressed condition;

means associated with said ram means for attaching said ram means to the base of a tree and pulling the tree through said compressing and binding means toward the other of said first and second ends of the table; and control means associated with said power means for controlling the ram means movement between said one position corresponding to the at least one movable part being moved to the extended position and an another position corresponding to the at least one movable part being moved to the retracted position such that said second end of said flexible member is caused to be drivingly moved from a first position coinciding generally with the location of said compressing and binding means to a second position coinciding with the location of the other of said first and second ends of the frame.

* * * * *